US011486024B2

(12) United States Patent
Yokota et al.

(10) Patent No.: US 11,486,024 B2
(45) Date of Patent: Nov. 1, 2022

(54) HEAT-RESISTANT IR ALLOY WIRE

(71) Applicants: ISHIFUKU METAL INDUSTRY CO., LTD., Tokyo (JP); DENSO CORPORATION, Kariya (JP)

(72) Inventors: Shunsuke Yokota, Soka (JP); Kenta Terai, Soka (JP); Hayato Yasuhara, Soka (JP); Ryohei Akiyoshi, Kariya (JP); Ken Hanashi, Kariya (JP); Ikuya Ando, Kariya (JP)

(73) Assignees: ISHIFUKU METAL INDUSTRY CO., LTD., Tokyo (JP); DENSO CORPORATION, Kariya (JP)

( * ) Notice: Subject to any disclaimer, the term of this patent is extended or adjusted under 35 U.S.C. 154(b) by 0 days.

(21) Appl. No.: 17/538,320

(22) Filed: Nov. 30, 2021

(65) Prior Publication Data

US 2022/0170136 A1 Jun. 2, 2022

(30) Foreign Application Priority Data

Nov. 30, 2020 (JP) ..... JP2020-197747

(51) Int. Cl.

| | |
|---|---|
| ***C22C 5/04*** | (2006.01) |
| ***B22F 5/12*** | (2006.01) |
| *C22F 1/14* | (2006.01) |

(52) U.S. Cl.

CPC ..... *C22C 5/04* (2013.01); *B22F 5/12* (2013.01); *C22F 1/14* (2013.01)

(58) Field of Classification Search

CPC ..... C22C 5/02; C22F 1/14

See application file for complete search history.

(56) References Cited

U.S. PATENT DOCUMENTS 11,131,008 B2 * 9/2021 Yokota ..... C22C 5/04
2019/0338395 A1 11/2019 Yokota et al.

FOREIGN PATENT DOCUMENTS

JP 2018-104816 A 7/2018

* cited by examiner

*Primary Examiner* — Jessee R Roe
(74) *Attorney, Agent, or Firm* — Oliff PLC

(57) ABSTRACT

Provided is an Ir alloy wire, which is further improved in oxidation wear resistance while ensuring a Vickers hardness. The Ir alloy wire includes: 5 mass % to 30 mass % of Rh; and 0.5 mass % to 5 mass % of Ta, wherein an average value A for an aspect ratio (crystal grain length/crystal grain width) of a structure of the alloy wire in a range of a depth of 0.05 mm or less from a surface of the alloy wire satisfies $1 \leq A < 6$.

7 Claims, 2 Drawing Sheets

COMPARATIVE EXAMPLE 3

EXAMPLE 3

COMPARATIVE EXAMPLE 3

EXAMPLE 3

HEAT-RESISTANT IR ALLOY WIRE

BACKGROUND OF THE INVENTION

1. Field of the Invention

The present invention relates to a heat-resistant Ir alloy wire.

2. Description of the Related Art

Various alloys have been developed as heat-resistant materials to be used for a crucible for high temperature, a heat-resistant device, a gas turbine, a spark plug, a sensor for high temperature, a jet engine, and the like. As major heat-resistant materials, there are given, for example, heat-resistant steel, a nickel-based superalloy, a platinum alloy, and tungsten. The heat-resistant steel, the nickel-based superalloy, the platinum alloy, and the like have solidus points of less than 2,000° C., and hence cannot be used at a temperature of 2,000° C. or more. Meanwhile, high-melting point metals, such as tungsten and molybdenum, suffer from severe oxidation wear in the air at high temperature. In view of the foregoing, an Ir alloy has been developed as a heat-resistant material having a high melting point and having high oxidation wear resistance.

In Japanese Patent Application Laid-open No. 2018-104816, there is disclosed an Ir alloy obtained by adding 0.5 mass % to 5 mass % of Ta, and additionally adding 0 mass % to 5 mass % of at least one kind of element selected from the group consisting of: Co; Cr; and Ni to an Ir—Rh alloy including 5 mass % to 30 mass % of Rh. There is described that, when Ta is added to the Ir—Rh alloy, an Ir alloy which is excellent in high temperature strength while ensuring oxidation wear resistance at high temperature can be provided.

There is a general issue that an Ir alloy wire to be used as the heat-resistant material needs to be further improved in oxidation wear resistance at high temperature.

SUMMARY OF THE INVENTION

In view of the foregoing, an object of the present invention is to provide an Ir alloy wire, which is further improved in oxidation wear resistance while ensuring a Vickers hardness.

The inventors of the present invention have found that, based on the conception that the oxidation wear of an Ir alloy occurs from a grain boundary, when an Ir—Rh material having added thereto Ta is used and a surface portion thereof is recrystallized to reduce the grain boundary, the oxidation wear resistance is remarkably improved while also the surface portion maintains a hardness almost comparable to that of an inside. Thus, the inventors have arrived at the present invention. That is, the present invention has been achieved for the first time by the combination of an Ir—Rh—Ta alloy, which has a high hardness, and a technology for improving the surface structure (crystal structure) thereof.

According to at least one embodiment of the present invention, there is provided an Ir alloy wire, consisting of: 5 mass % to 30 mass % of Rh; 0.5 mass % to 5 mass % of Ta; and Ir as the balance. In the Ir alloy wire, an average value A for an aspect ratio of a structure (crystal structure) of the alloy wire in a range of a depth of 0.05 mm or less from a surface of the alloy wire satisfies $1 \leq A < 6$. The aspect ratio is a ratio of crystal grain length/crystal grain width of the structure of the alloy wire. In this invention, an average value for the aspect ratio in a range of a depth of 0.05 mm or less from a surface of the alloy wire is referred to as an average value "A".

In the above-mentioned configuration, when a wire diameter of the alloy wire is represented by 2r, an average value B for the aspect ratio (crystal grain length/crystal grain width) of the structure of the alloy wire in a range of a wire diameter of up to 0.6r from a center axis of the alloy wire may satisfy $6 \leq B$. In this invention, an average value for the aspect ratio in a range of a wire diameter of up to 0.6r from a center axis of the alloy wire is referred to as an average value "B".

In the above-mentioned configuration, a value for a Vickers hardness of the alloy wire in a range of a depth of 0.05 mm or less from the surface of the alloy wire may be 450 HV or more.

In the above-mentioned configuration, when a wire diameter of the alloy wire is represented by 2r, a value for a Vickers hardness of the alloy wire in a range of a wire diameter of up to 0.6r from a center axis of the alloy wire may be 450 HV or more.

According to the present invention, the Ir alloy wire, which is excellent in oxidation wear resistance while ensuring a Vickers hardness, can be provided.

DESCRIPTION OF THE EMBODIMENTS

Figure 1:
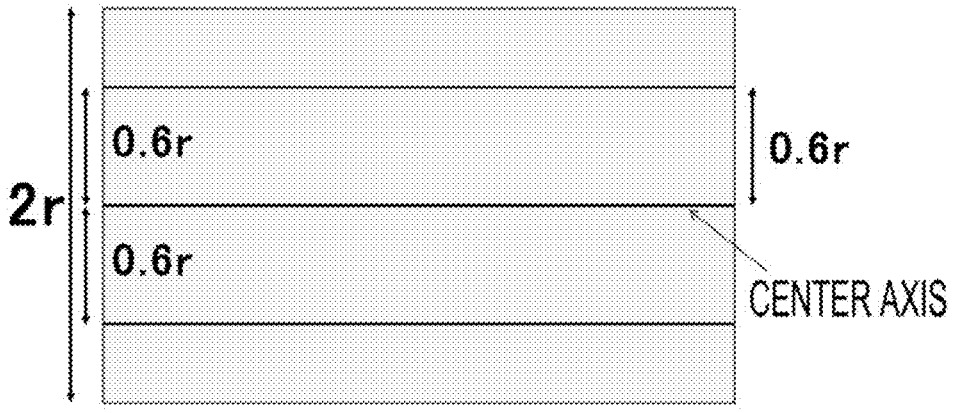
FIG. 1 is a schematic view of a cut surface (longitudinal cross section) in a plane including a center axis.

The present invention relates to an Ir alloy wire, including: 5 mass % to 30 mass % of Rh; and 0.5 mass % to 5 mass % of Ta, with the balance being Ir. The wire diameter of the Ir alloy wire is not particularly limited, and may be set to, for example, 0.25 mm or more. In Examples described below, the wire diameter of the Ir alloy wire is set to 0.8 mm as an example.

The Ir alloy wire has the following feature: an average value A for an aspect ratio (crystal grain length/crystal grain width) of the structure of the alloy wire in the range of a depth of 0.05 mm or less from a surface of the alloy wire satisfies $1 \leq A < 6$. The "Ir alloy" refers to an alloy including Ir as a main element. The Ir alloy wire according to at least one embodiment of the present invention may include inevitable impurities in addition to the above-mentioned elements. The presence or absence of the inevitable impurities does not affect the above-mentioned effects.

When the Ir alloy includes 5 mass % to 30 mass % of Rh, oxidative volatilization of Ir from a crystal grain boundary is suppressed in the air at high temperature or in an oxidizing atmosphere, and the oxidation wear resistance of the alloy is remarkably improved. When the content of Rh is less than 5 mass %, the oxidation wear resistance of the Ir alloy is insufficient. Meanwhile, when the content of Rh is more than 30 mass %, the oxidation wear resistance of the Ir alloy is satisfactory, but the melting point of the Ir alloy is reduced.

The content of Rh is preferably from 7 mass % to 25 mass %.

When an Ir—Rh alloy includes 0.5 mass % to 5 mass % of Ta, the hardness of the alloy is increased through solid solution hardening due to Ta. The content of Ta is preferably 0.7 mass % or more. When the content of Ta is less than 0.5 mass %, the solid solution hardening is insufficient. Meanwhile, when the content of Ta is more than 5 mass %, it becomes difficult to process the alloy owing to a reduction in plastic deformability.

The Ir—Rh—Ta alloy may include 0 mass % to 5 mass % of at least one kind of element selected from the group consisting of: Co; Cr; and Ni. When the Ir—Rh alloy includes 0 mass % to 5 mass % of the at least one kind of element selected from the group consisting of: Co; Cr; and Ni, the hardness of the alloy is further increased through solid solution hardening due to these elements.

The average value A for the aspect ratio (crystal grain length/crystal grain width) of the structure of the Ir alloy wire in the range of a depth of 0.05 mm or less from the surface of the alloy wire satisfies $1 \leq A < 6$.

Herein, a method of manufacturing the Ir alloy wire according to at least one embodiment of the present invention is described. First, raw material powders (Ir powder, Rh powder, and Ta powder) are weighed at a predetermined ratio and mixed to obtain mixed powder. Then, the resultant mixed powder is melted, forged and processed to obtain an Ir alloy wire of, for example, from 0.3 mm to φ3.0 mm. The resultant Ir alloy wire is subjected to heat treatment during or after the processing so that the average value A for the aspect ratio (crystal grain length/crystal grain width) of the structure (crystal structure of a surface portion) of the alloy wire in the range of a depth of 0.05 mm or less from the surface of the alloy wire satisfies $1 \leq A < 6$. That is, the resultant Ir alloy wire is subjected to heat treatment during or after the processing so that the Ir alloy wire has a predetermined structure. Examples of a method for the heat treatment include: a method involving hot working at the time of processing and adopting an appropriate temperature for the hot working; and a method involving heating with a furnace, such as a muffle furnace or an annular furnace, or heating with a burner or through application of a current, after the processing.

In the method involving heating after the processing, the alloy wire may be heated, for example, at 1,000° C. to 1,100° C. for from several hours to several tens of hours in an argon atmosphere. For example, a heating time may be set to 10 hours. With such heat treatment, the surface portion of the alloy wire is recrystallized. The inside of the alloy wire is hardly recrystallized. While the value for the Vickers hardness of the alloy wire is slightly reduced both in the surface portion and in the inside, the hardness of the surface portion is almost comparable to that of the inside.

For example, when heat treatment involving heating at 1,000° C. to 1,100° C. for 10 hours in an argon atmosphere is performed after the processing, the surface portion of the alloy wire is recrystallized, and thus the average value A for the aspect ratio (crystal grain length/crystal grain width) of the structure (crystal structure of the surface portion) of the Ir alloy wire in the range of a depth of 0.05 mm or less from the surface of the alloy wire can satisfy $1 \leq A < 6$. When the surface portion is recrystallized in that manner, oxidation wear, which starts from a crystal grain boundary, is reduced, and thus the oxidation wear resistance is remarkably improved.

FIG. 1 is a schematic view of a cut surface (longitudinal cross section) in a plane including a center axis of the Ir alloy wire.

Figure 2:
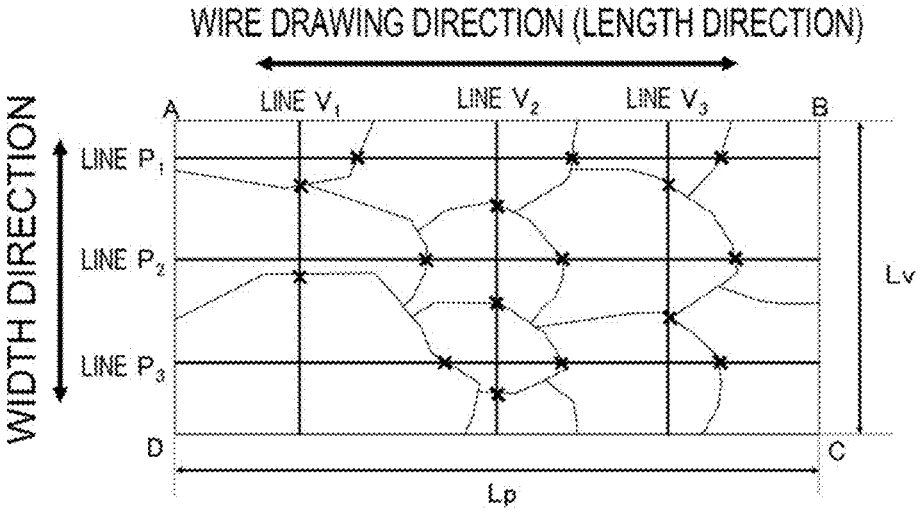
FIG. 2 is a schematic view of an example of a calculation method for an aspect ratio.

The aspect ratio of the structure of the Ir alloy wire is determined by a cutting method (referring to JIS G0551) through use of an image of a cross section taken with an optical microscope. An example is shown in FIG. 2. FIG. 2 shows an image of a cross section of a rectangle ABCD, in which the length of a side (a side AB and a side CD) in a wire drawing direction is represented by Lp, and the length of a side (a side AD and a side BC) in a vertical direction is represented by Lv. In the example shown in FIG. 2, line segments Pn (n=1, 2, . . . ) each having a length of Lp are drawn from arbitrary points on the side AD so as to be parallel to the wire drawing direction. In addition, line segments Vm (m=1, 2, . . .) each having a length of Lv are drawn from arbitrary points on the side AB so as to be vertical to the wire drawing direction. Then, the number of intersection points of each line segment with crystal grains is determined, and the number of crystal grains with which the line segment intersects is determined by adding 1 to the resultant number of intersection points. Next, a crystal grain length Lpn is calculated by dividing the length Lp by the number of crystal grains, and a crystal grain width Lvm are calculated by dividing the length Lv by the number of crystal grains. An average crystal grain length "p" is calculated by averaging the crystal grain length Lpn by the expression (Lp1+Lp2+ . . . +Lpn)/n, and an average crystal grain width "v" is calculated by averaging the crystal grain width Lvm by the expression (Lv1+Lv2+ . . . +Lvm)/m. Then, a ratio of p/v is used as the aspect ratio. Herein, FIG. 2 is a schematic view in the case in which "n" and "m" each represent 3.

For example, when the heat treatment involving heating at 1,000° C. to 1,100° C. for 10 hours in an argon atmosphere is performed after the processing, the surface portion of the alloy wire is recrystallized, but the inside of the alloy wire is hardly recrystallized. Specifically, as illustrated in FIG. 1, when the wire diameter of the Ir alloy wire is represented by 2r, an average value B for the aspect ratio (crystal grain length/crystal grain width) of the structure of the alloy wire in the range of a wire diameter of up to 0.6r from the center axis of the alloy wire satisfies $6 \leq B$. That is, when a needle-like structure in the state in which the alloy wire has been produced remains in a center portion, the average value B for the aspect ratio may satisfy $6 \leq B$.

The value for the Vickers hardness of the Ir alloy wire in the range of a depth of 0.05 mm or less from the surface of the alloy wire is 450 HV or more. The value for the Vickers hardness of the Ir alloy wire in the range of a depth of 0.05 mm or less from the surface of the alloy wire is preferably 460 HV or more.

In addition, when the wire diameter of the alloy wire is represented by 2r, the value for the Vickers hardness of the alloy wire in the range of a wire diameter of up to 0.6r from the center axis of the alloy wire may be 450 HV or more. The value for the Vickers hardness of the Ir alloy wire in the range of 60% or less of the radius of the alloy wire from the center axis of the alloy wire is preferably 480 HV or more.

The values for the Vickers hardness are measured as described below with reference to In FIG. 1. It is assumed that a reference line passes through a midpoint of a center axis of a polished surface obtained by polishing the longitudinal cross section illustrated in FIG. 1, and the reference line is orthogonal to the center axis. Based on the above assumption, a hardness (center hardness) at the midpoint and a hardness (surface hardness) at a point having a distance of 0.04 mm from an outer side on the reference line are measured.

When the value for the Vickers hardness is 450 HV or more, high durability can be retained even under a usage environment at high temperature.

The present invention is described more specifically below by way of Examples.

EXAMPLES

Examples of the present invention are described. First, raw material powders (Ir powder, Rh powder, and Ta powder) were mixed at a predetermined ratio to obtain mixed powder. Next, the resultant mixed powder was molded with a uniaxial pressing machine to provide a green compact. The resultant green compact was melted by an arc melting method to produce an ingot.

Next, the ingot thus produced was subjected to hot forging to provide a square bar having a width of 15 mm. The square bar was subjected to hot groove rolling and wire drawing die processing to provide an alloy wire of φ0.8 mm. The alloy wire was cut into a length of 0.6 mm with a wire saw. Thus, a column-shaped test piece having a diameter of 0.8 mm and a height of 0.6 mm was produced.

Next, the test piece was subjected to heat treatment in an argon atmosphere under various conditions so that the average value A for the aspect ratio (crystal grain length/crystal grain width) of the structure (crystal structure of the surface portion) of the Ir alloy wire in the range of a depth of 0.05 mm or less from the surface of the alloy wire satisfied $1 \leq A < 6$. That is, the test piece was subjected to heat treatment in an argon atmosphere under various conditions so that the Ir alloy wire had a predetermined structure.

Each test piece was cut in a plane including a center axis of the column (longitudinal cross section), the cross section was polished, and an image of the polished surface was taken with an optical microscope.

For the structure of the test piece (Ir alloy wire), the average crystal grain length "p" and the average crystal grain width "v" of crystal grains were calculated by the cutting method through use of the image of the rectangular longitudinal cross section. Then, the average value A and the average value B for the aspect ratio (crystal grain length/crystal grain width) were determined based on the ratio of p/v.

The Vickers hardness was measured as described below. A reference line, which passed through a midpoint of a center axis of a polished surface, and was orthogonal to the center axis, was assumed. Based on the above assumption, a hardness (center hardness) at the midpoint and a hardness (surface hardness) at a point having a distance of 0.04 mm from an outer side on the reference line were measured. The Vickers hardness was measured under the conditions of a load of 200 gf and 10 seconds with a micro Vickers hardness tester.

The oxidation wear resistance was evaluated by a high-temperature oxidation test using the test piece. The high-temperature oxidation test was performed by setting the test piece in an electric furnace, and retaining the test piece in the air under the condition of 1,050° C. for 20 hours. The oxidation wear resistance was defined as a mass change per 1 $mm^2$ ($\Delta M$ ($mg/mm^2$)) through the high-temperature oxidation test. That is, the mass change per 1 $mm^2$ was determined by the following equation: $\Delta M=(M1-M0)/S$, where M0 represents the mass (mg) of the test piece before the test, M1 represents the mass (mg) of the test piece after the test, and S represents the surface area ($mm^2$) of the test piece before the test. In addition, the surface area S ($mm^2$) of the test piece was calculated from the dimensions of the test piece.

An improving effect on the oxidation wear resistance by structural control was evaluated through use of a wear ratio. That is, in the alloy wires having the same composition, a mass change of a test piece not having been subjected to the heat treatment through the high-temperature oxidation test was represented by $\Delta M0$, and a ratio of $\Delta M$ of a test piece to be compared to the $\Delta M0$, ($\Delta M/\Delta M0$), was used as the wear ratio. Accordingly, the wear ratio of the test piece not having been subjected to the heat treatment is 1. For the wear ratio of the test piece having been subjected to the heat treatment, a value closer to 0 is better.

For test pieces each having a composition of Ir10Rh3Ta (mass %), data on their hardnesses and wear ratios in the case of having been subjected to heat treatment in an argon atmosphere under various conditions are shown in Table 1.

TABLE 1

| Heat treatment conditions | Center hardness HV | Surface hardness HV | Wear ratio |
|---|---|---|---|
| None (as a processed material) | 606 | 609 | 1 |
| 1,100° C. 10 h | 527 | 525 | 0.67 |
| 1,150° C. 0.5 h | 517 | 531 | 0.87 |
| 1,150° C. 1.5 h | 515 | 526 | 0.74 |
| 1,150° C. 5 h | 503 | 517 | 0.50 |
| 1,150° C. 10 h | 488 | 459 | 0.41 |
| 1,200° C. 0.5 h | 521 | 486 | 0.59 |
| 1,300° C. 0.5 h | 357 | 343 | 0.37 |
| 1,400° C. 0.5 h | 357 | 342 | 0.32 |
| 1,500° C. 0.5 h | 345 | 337 | 0.26 |

From Table 1, it is revealed that, when the heat treatment is performed, oxidation wear is suppressed, whereas the hardness is gradually reduced. Through the heat treatment at 1,300° C. or more, the wear ratio is good, but the hardness is significantly reduced. In view of the foregoing, the conditions of 1,100° C. and 10 h, in which the wear ratio was improved by about 30% while a high hardness was maintained, were selected as appropriate heat treatment conditions for Ir10Rh3Ta. With regard to other alloys, appropriate treatment conditions were set in the same manner, and samples of Examples 1 to 6 were produced. Untreated samples were used as Comparative Examples 1 to 6. However, the heat treatment conditions for obtaining a predetermined structure are not limited to those conditions.

The compositions and various characteristics of the alloys of Examples and Comparative Examples are shown in Table 2. In each of Examples, a heat treatment time was set to 10 h.

TABLE 2

| Number | Composition (mass %) Ir | Rh | Ta | Heat treatment temperature | Aspect ratio A | B | Hardness HV Surface | Center | Wear ratio |
|---|---|---|---|---|---|---|---|---|---|
| Comparative Example 1 | Balance | 5 | 3 | None | 23 | 20 | 663 | 649 | 1 |
| Example 1 | | | | 1,100° C. | 2 | 8 | 539 | 618 | 0.73 |
| Comparative Example 2 | Balance | 10 | 1 | None | 44 | 50 | 573 | 559 | 1 |
| Example 2 | | | | 1,050° C. | 3 | 28 | 471 | 501 | 0.66 |
| Comparative Example 3 | Balance | 10 | 3 | None | 48 | 30 | 609 | 606 | 1 |
| Example 3 | | | | 1,100° C. | 4 | 25 | 525 | 527 | 0.67 |
| Comparative Example 4 | Balance | 10 | 5 | None | 28 | 22 | 623 | 618 | 1 |
| Example 4 | | | | 1,100° C. | 5 | 30 | 563 | 606 | 0.63 |
| Comparative Example 5 | Balance | 30 | 1 | None | 29 | 39 | 518 | 511 | 1 |
| Example 5 | | | | 1,000° C. | 3 | 18 | 465 | 496 | 0.60 |
| Comparative Example 6 | Balance | 30 | 5 | None | 37 | 29 | 598 | 593 | 1 |
| Example 6 | | | | 1,100° C. | 2 | 21 | 485 | 490 | 0.72 |

In each of Examples 1 to 6, the average value A for the aspect ratio of the structure of the alloy wire (crystal grain length/crystal grain width) in the range of a depth of 0.05 mm or less from the surface of the alloy wire was from 2 to 5. Meanwhile, the average value B for the aspect ratio (crystal grain length/crystal grain width) of the structure of the alloy wire in the range of 60% or less of the radius of the alloy wire from the center axis of the alloy wire was from 8 to 30.

Figure 3A:
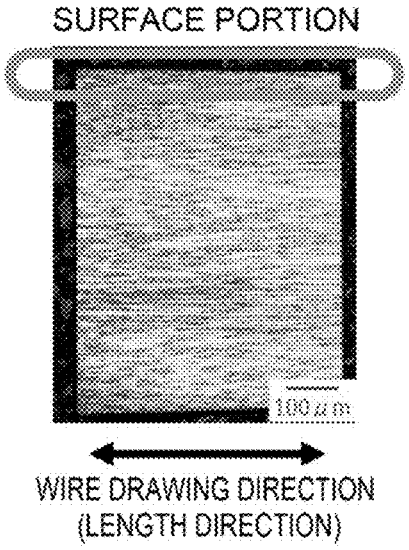
FIG. 3A is a photograph of the structure of a longitudinal cross section in Comparative Example 3.
Figure 3B:
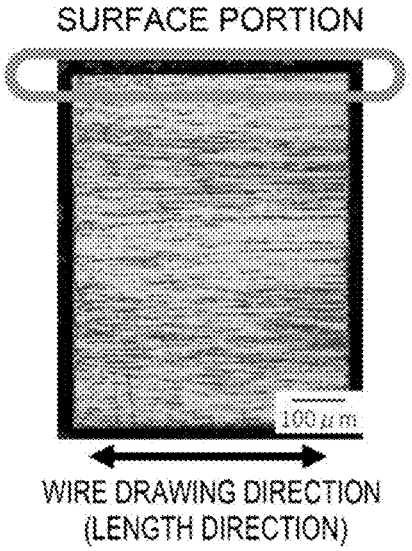
FIG. 3B is a photograph of the structure of a longitudinal cross section in Example 3.

The structure of the longitudinal cross section in Comparative Example 3 is shown in FIG. 3A, and the structure of the longitudinal cross section in Example 3 is shown in FIG. 3B. The surface portion in the structure of the longitudinal cross section in Comparative Example 3 is shown in FIG. 4A, and the surface portion in the structure of the longitudinal cross section in Example 3 is shown in FIG. 4B.

In each of FIG. 3A and FIG. 3B, it is recognized that a needle-like structure in the state in which the Ir alloy wire has been produced remains in the inside of the alloy wire, and the inside is hardly recrystallized.

Figure 4A:
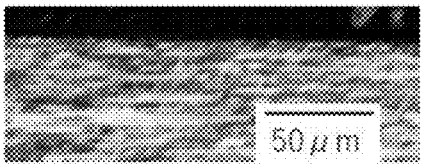
FIG. 4A is a photograph of a surface portion in the structure of the longitudinal cross section in Comparative Example 3.
Figure 4B:
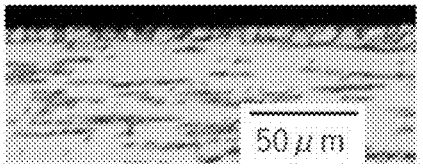
FIG. 4B is a photograph of a surface portion in the structure of the longitudinal cross section in Example 3.

Next, for the surface portions of the Ir alloy wires, it is recognized that, in Comparative Example shown in FIG. 4A, a needle-like structure in the state in which the alloy wire has been produced remains in the surface portion of the alloy wire, whereas in Example shown in FIG. 4B, the surface portion of the alloy wire is recrystallized.

In each of Examples 1 to 6, the value for the surface hardness of the alloy wire was from 465 HV to 563 HV. Meanwhile, the value for the center hardness of the alloy wire was from 490 HV to 618 HV. In each of Examples 1 to 6, the surface hardness was from 87% to 99% of the center hardness. In each of Examples 1 to 6, the wear ratio was from 0.60 to 0.73.

It was recognized that the alloy wires of Examples were each improved in oxidation wear resistance while maintaining a high hardness, and hence each had excellent characteristics as a heat-resistant Ir alloy.

What is claimed is:

1. An Ir alloy wire, comprising:

5 mass % to 30 mass % of Rh; and 0.5 mass % to 5 mass % of Ta, wherein an average value A for an aspect ratio (crystal grain length/crystal grain width) of a structure of the alloy wire in a range of a depth of 0.05 mm or less from a surface of the alloy wire satisfies $1 \leq A < 6$.

2. The Ir alloy wire according to claim 1, wherein, when a wire diameter of the alloy wire is 2r, a value for a Vickers hardness of the alloy wire in a range from a center axis of the alloy wire to 0.6r is 450 HV or more.

3. The Ir alloy wire according to claim 1, wherein, when a wire diameter of the alloy wire is 2r, an average value B for the aspect ratio (crystal grain length/crystal grain width) of the structure of the alloy wire in a range from a center axis of the alloy wire to 0.6r satisfies $6 \leq B$.

4. The Ir alloy wire according to claim 2, wherein a value for a Vickers hardness of the alloy wire in a range of a depth of 0.05 mm or less from the surface of the alloy wire is 450 HV or more.

5. The Ir alloy wire according to claim 3, wherein, when a wire diameter of the alloy wire is 2r, a value for a Vickers hardness of the alloy wire in a range from a center axis of the alloy wire to 0.6r is 450 HV or more.

6. The Ir alloy wire according to claim 1, wherein a value for a Vickers hardness of the alloy wire in a range of a depth of 0.05 mm or less from the surface of the alloy wire is 450 HV or more.

7. The Ir alloy wire according to claim 6, wherein, when a wire diameter of the alloy wire is 2r, a value for a Vickers hardness of the alloy wire in a range from a center axis of the alloy wire to 0.6r is 450 HV or more.

* * * * *